US012679616B2

(12) United States Patent
Smith

(10) Patent No.: US 12,679,616 B2
(45) Date of Patent: Jul. 14, 2026

(54) CHIP BAG

(71) Applicant: R. G. BARRY CORPORATION, Pickerington, OH (US)

(72) Inventor: Lee F. Smith, Pickerington, OH (US)

(73) Assignee: R. G. BARRY CORPORATION, Pickerington, OH (US)

( * ) Notice: Subject to any disclaimer, the term of this patent is extended or adjusted under 35 U.S.C. 154(b) by 129 days.

(21) Appl. No.: 18/298,701

(22) Filed: Apr. 11, 2023

(65) Prior Publication Data

US 2024/0343460 A1 Oct. 17, 2024

(51) Int. Cl.
*B65D 73/00* (2006.01)
*A47F 5/00* (2006.01)
(Continued)

(52) U.S. Cl.
CPC ..... *B65D 73/0007* (2013.01); *A47F 5/0025* (2013.01); *B65D 33/004* (2013.01); *B65D 33/12* (2013.01); *B65D 33/14* (2013.01); *B65D 33/28* (2013.01); *B65D 73/0064* (2013.01); *B65D 85/187* (2013.01); *B65D 2203/02* (2013.01); *B65D 2203/06* (2013.01)

(58) Field of Classification Search
CPC ..... B65D 73/00; B65D 73/0007; B65D 73/0021; B65D 73/0035; B65D 73/0042; B65D 73/0064; B65D 33/004; B65D 33/06; B65D 33/065; B65D 33/10; B65D 33/12; B65D 33/14; B65D 85/18; B65D 85/187; B65D 2203/00; B65D 2203/02; B65D 2203/06
See application file for complete search history.

(56) References Cited

U.S. PATENT DOCUMENTS 3,145,908 A * 8/1964 Smith ..... B65D 77/10 383/20
9,033,577 B2 * 5/2015 Rednour ..... B65D 81/36 383/105
(Continued)

FOREIGN PATENT DOCUMENTS

CN 101151194 A 3/2008
JP 8-53126 A 2/1996

OTHER PUBLICATIONS

"Parrack images NPL"; Parrack, "Hangbags are both bags and hangers for your new clothes", New Atlas, 6 pages, found online at: https://newatlas.com/hangbags-bags-hangers/30035/, published Dec. 6, 2013 by MIT Institute of Design (Year: 2013).*
(Continued)

*Primary Examiner* — Javier A Pagan
(74) *Attorney, Agent, or Firm* — Vorys, Sater, Seymour and Pease LLP; Khaled Shami

(57) ABSTRACT

A retail product assembly includes a combination display "chip" and gift bag. A gift bag is folded into a generally flat configuration with a plurality of adjacent layers and is used as a replacement for a cardboard chip. Retail articles, such as a pair of slippers, are attached to the folded gift bag for display at a retail market. When a consumer purchases the pair of slippers, the slippers may be detached from the folded gift bag, and inserted into an interior of the gift bag, once unfolded and opened. The slippers may then be readily transported within the gift bag and presented as a gift.

12 Claims, 9 Drawing Sheets

(51) Int. Cl.

| | |
|---|---|
| ***B65D 33/00*** | (2006.01) |
| ***B65D 33/12*** | (2006.01) |
| ***B65D 33/14*** | (2006.01) |
| ***B65D 33/28*** | (2006.01) |
| ***B65D 85/18*** | (2006.01) |

(56) References Cited

U.S. PATENT DOCUMENTS

| | | | | |
|---|---|---|---|---|
| 2005/0150137 | A1* | 7/2005 | Steidle | A47G 25/005 36/136 |
| 2007/0023370 | A1* | 2/2007 | Emery | A47G 25/005 211/72 |
| 2007/0125669 | A1* | 6/2007 | Lee | B65D 85/187 206/286 |
| 2011/0253567 | A1 | 10/2011 | Cossey | |
| 2013/0153454 | A1* | 6/2013 | Glass | B65D 81/365 206/457 |
| 2014/0190850 | A1* | 7/2014 | Glass | G09F 1/06 206/232 |
| 2016/0264303 | A1* | 9/2016 | Borges | B65D 33/004 |

OTHER PUBLICATIONS

H&M Sustainable Retail Bag, 1 page—found online at: https://www.behance.net/gallery/18587077/H-M-Sustainable-Retail-Packaging, published Jul. 24, 2014 by the H&M Group.

Sanye-Mengual et al., "Chapter 14—Ecodesign and Product Carbon Footprint use in the packaging sector", 27 pages—found online at: https://www.researchgate.net/publication/276266546_Eco-Design_and_Product_Carbon_Footprint_Use_in_the_Packaging_Sector, published Jan. 1, 2014 by the European Commission | Inédit | Autonomous University of Barcelona.

Parrack, "Hangbags are both bags and hangers for your new clothes", New Atlas, 4 pages, found online at: https://newatlas.com/hangbags-bags-hangers/30035/, published Dec. 6, 2013 by MIT Institute of Design.

* cited by examiner

CHIP BAG

FIELD OF THE DISCLOSURE

The present disclosure relates generally to a product assembly for retail display and sale. More particularly, the disclosure is directed to a product assembly for retaining retail articles in a hanging or other display configuration in a retail market, and for allowing a purchaser to package the articles for transport or gifting.

BACKGROUND OF THE DISCLOSURE

Display chips are commonly used in association with products or articles in a retail market. Display chips generally provide at least brand identification information and are attached to retail articles which are on display for sale. Display chips often include a hanger which allows the display chip to hang from a rail. This in turn allows the display chip to suspend the retail article. Alternatively, the display chips may retain articles for arrangement with similar articles in a tray or other display configuration.

Often, a retail article retained on a display chip is purchased to be given as a gift. The purchaser may also purchase a gift box to wrap the article with wrapping paper or a gift bag to decorate and conceal the gift from the intended recipient. The purchase of additional accessories for gift giving may be time consuming and inconvenient for a purchaser. Additionally, additional accessories for gift giving may be wasteful. For example, shopping bags may be provided for both the retail articles and for the accessories, which are usually discarded by the purchaser, while the wrapping accessories and display chip are usually discarded by the recipient. A more convenient and environmentally sustainable option for the display, sale and gifting of retail articles could prove beneficial.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a product assembly includes a gift bag folded into a generally flat chip. The chip includes a plurality of adjacent layers and defining a forward exterior surface thereon. At least one retail article is secured to the forward exterior surface. The gift bag, when unfolded and opened, is arranged to receive the at least one retail article into an interior thereof once the at least one retail item is detached from the forward exterior surface.

In another embodiment, a product display includes an upright support for supporting the product display on a ground surface. A plurality of product support structures extend from the upright support. A plurality of product assemblies supported by each support structure, each product assembly including a gift bag folded into a generally flat chip including a plurality of adjacent layers and defining a forward exterior surface thereon and at least one retail article secured to the forward exterior surface.

According to another embodiment, a method for forming and using a product assembly includes (a) folding a gift bag into a generally flat chip including a plurality of adjacent layers and defining a forward exterior surface thereon, and (b) affixing a retail article onto the forward exterior surface to define the product assembly. The retail article may be detached from the forward exterior surface, and the retail article may be inserted into an interior of the gift bag.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
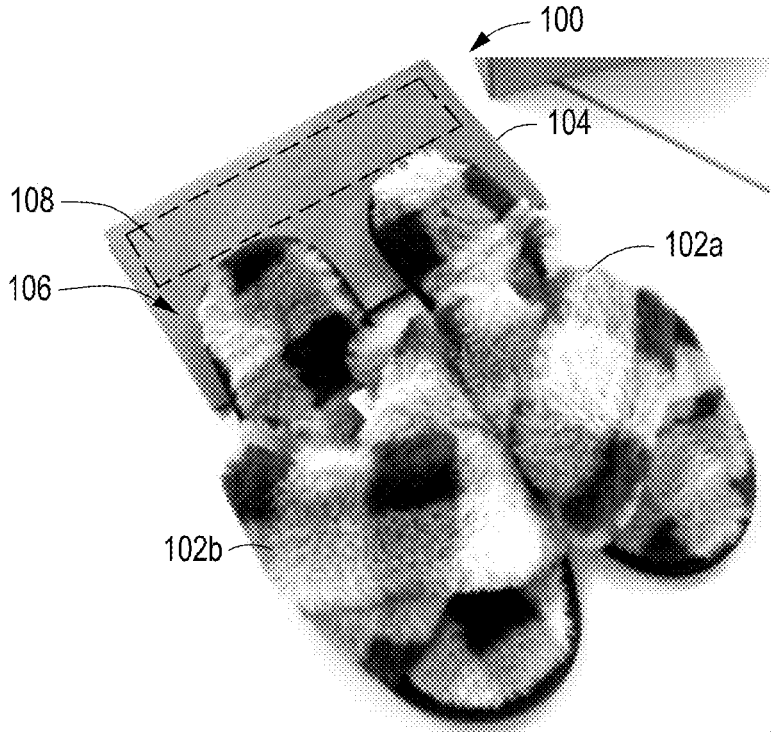
FIG. 1A is a perspective view of a product assembly in an initial configuration wherein a retail article is retained on an exterior of a gift bag folded into a display chip in accordance with example embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate a product assembly including a combination "chip" and gift bag. Conventionally, the chip is a flat cardboard plate to which the retail articles are secured for hanging and display at a retail market. The new combination comprises a folded gift bag which is used as a replacement of the cardboard chip, and to which the articles, such as a pair of slippers, are attached for display at the retail market. When a consumer purchases the pair of slippers, the slippers may be detached from the folded gift bag, and inserted within the gift bag, once unfolded, for transport and for presentation as a gift. The folded gift bag may be FIG. 1A is a perspective view of a product assembly 100 in an initial configuration for display in a retail market. The product assembly 100 generally includes one or more retail articles 102*a*, 102*b* coupled to an exterior of a gift bag 104 folded to form a flat, rectangular chip. The gift bag 104 may be constructed of paper or a similar material, and may be folded and held together with adhesives as recognized in the art. As illustrated in FIG. 1, the retail articles 102*a*, 102*b* include a footwear set, and specifically, a matching pair of slippers. In other embodiments, retail articles may include other apparel items such as gloves, hats or belts, or non-apparel items such as kitchen utensils, tools or gift cards. The retail articles 102*a*, 102*b* are affixed to an exterior of the gift bag 104 on a forward exterior surface 106 thereof, and are arranged in a side-by-side relationship with one another. The retail articles 102*a*, 102*b* may be secured to the chip formed from the gift bag 104 with adhesives, barbed tagging fasteners (see FIG. 2A), zip ties or other fasteners recognized in the art. The retail articles 102*a*, 102*b* extend beyond an edge of the forward exterior surface 106 and do not obscure an upper region 108 of the exterior surface 106. As described in greater detail below, the upper region 108 of the exterior surface is available for product identification and/or other information and designs.

The gift bag 104 is folded into a rectangular plate or chip defining the forward exterior surface 106 thereon. As illustrated in FIG. 1A, the gift bag 104 is folded so that a base panel 110 (FIG. 1B) thereof is arranged behind the forward exterior surface 106 and generally parallel to the forward exterior surface 106. The base panel 110 may be generally flat and rectangular. Once folded, the several adjacent parallel layers provide sufficient stiffness to the gift bag 104 to allow the gift bag 104 to effectively support the retail articles 102*a*, 102*b* as the product assembly 100 is handled by a consumer. In some embodiments, the several layers may be secured to one another with any of the mechanisms described above for securing the retail articles 102*a*, 102*b* to the gift bag 104. In some embodiments, a fastener (see FIG. 3) may extend through one of the retail articles 102*a*, 102*b* as well as the several layers such that the same fastener affixes the retail article 102*a*, 102*b* to the gift bag 104 and retains the gift bag 104 in the folded configuration of a chip.

Figure 1B:
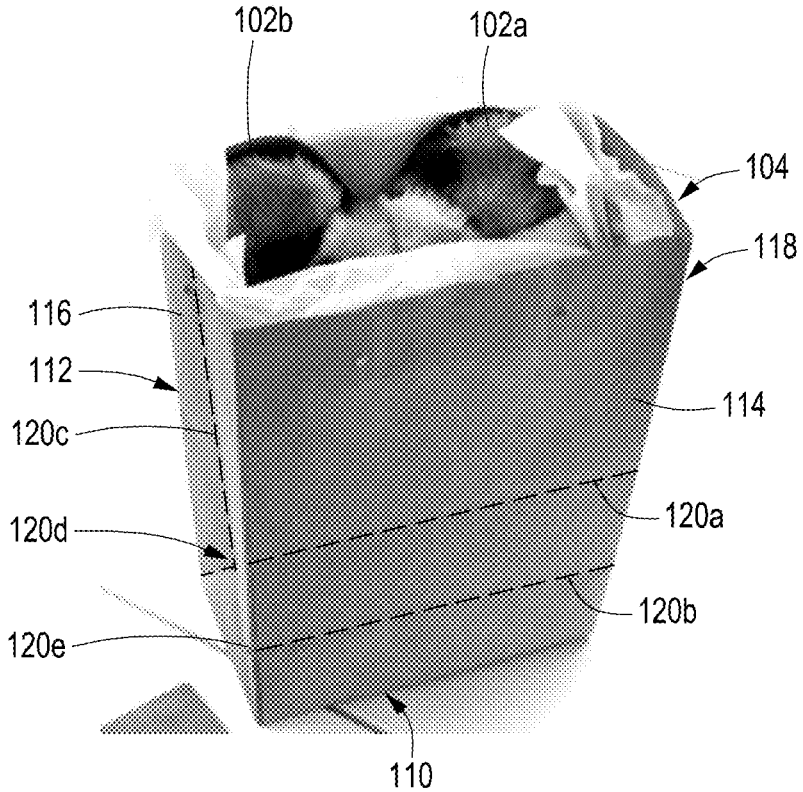
FIG. 1B is a perspective view of the product assembly of FIG. 1A in a secondary configuration wherein the retail article is contained within the unfolded gift bag.

Referring to FIG. 1B, the product assembly 100 is arranged in a secondary configuration wherein the retail articles 102*a*, 102*b* are contained within an interior of the unfolded gift bag 104. The gift bag 104 is unfolded such that the gift bag 104 may be supported on the base panel 110 on a generally horizontal surface. Front and rear panels 112, 114, and side panels 116, 118 of the gift bag 104 extend vertically from the base panel 110 and circumscribe the retail articles 102*a*, 102*b* such that the retail articles 102*a*, 102*b* are contained within the gift bag 104. Creases or fold lines 120*a*, 120*b*, 120*c*, 120*d*, 120*e* may be provided in various configurations to facilitate folding the gift bag 104 into the form of the chip. Tissue paper 122 may be provided within the gift bag 104 for obscuring the retail articles 102*a*, 102*b* when the product assembly 100 is given as a gift. The tissue paper 122 may contribute to the stiffness of the chip when the product assembly 100 is arranged in the initial configuration of FIG. 1A.

Figure 2A:
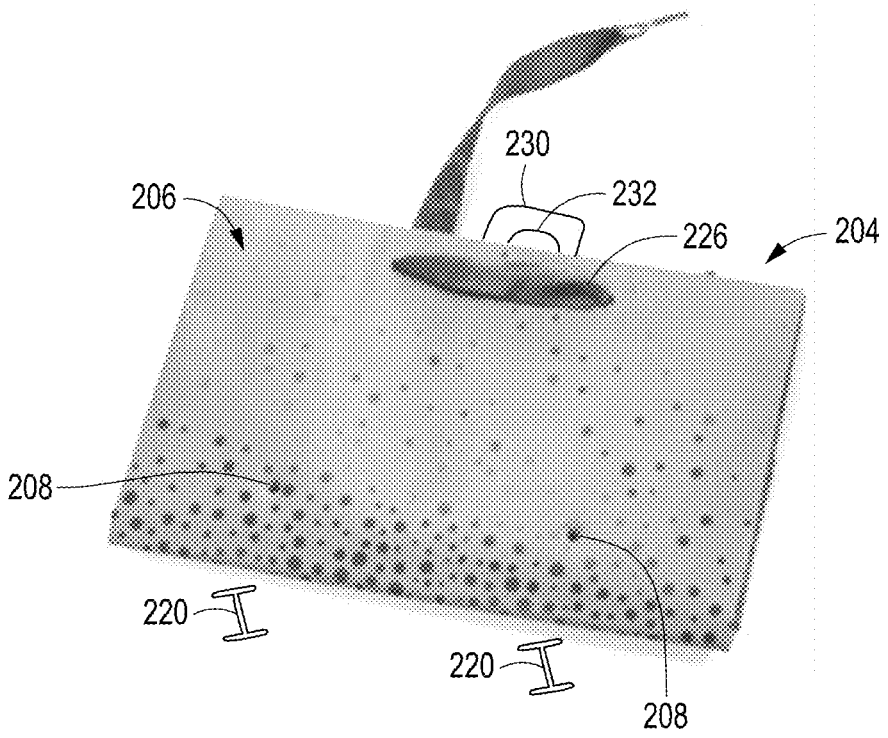
FIGS. 2A and 2B are front views of an alternate embodiment of a gift bag in an initial folded configuration and a secondary, partially unfolded configuration, respectively.
Figure 2B:
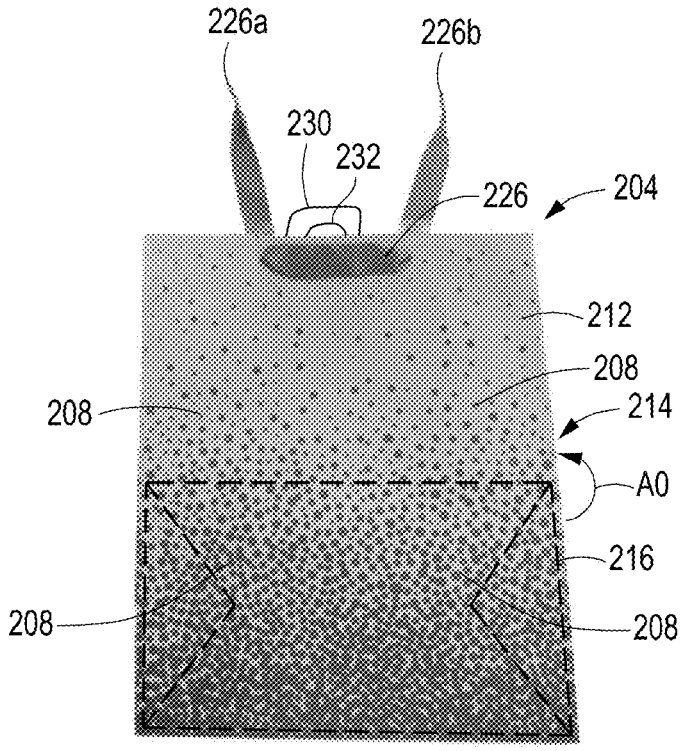

Referring to FIGS. 2A and 2B, an alternate embodiment of a gift bag 204 is illustrated. The gift bag 204 is illustrated in an initial configuration folded into a chip (FIG. 2A) and a secondary, partially-unfolded configuration (FIG. 2B). In the initial configuration of FIG. 2A, a forward exterior surface 206 includes a pair of spaced apart fastening holes 208 therein. In some embodiments, the fastening holes 208 extend only through a front panel 212 of the gift bag 204, and in other embodiments, the fastening holes 208 may extend through each of the various layers of the gift bag 204 in the folded configuration, including at least the front panel 212, a rear panel 214 and a base panel 216. The fastening holes 208 may each receive a barbed fastener 220 therein to retain the retail items 102*a*, 102*b* (FIG. 1A) to the exterior of the gift bag 204, and/or to retain the layers including the front panel 212, rear panel 214 and base panel 216 adjacent one another in the folded configuration of FIG. 2A. The barbed fasteners 220 may be constructed of a flexible plastic material, which may be cut with scissors for removal.

The gift bag 204 includes a handle 226 attached to the front panel 212, and may include a complimentary handle 226 attached to the rear panel 214. The handle 226 may be formed of a ribbon, thread, twisted paper strands or other flexible materials. Ends 226*a*, 226*b* of the handle 226 may be retained within the gift bag 204 when the gift bag 204 is folded into a chip in the initial configuration of FIG. 2A. An optional adhesive tab 230 protrudes from an interior of the gift bag 204 and provides a structure from which the gift bag 204 may be suspended in a retail display (see FIG. 3A). The adhesive tab 230 may be constructed of a thin plastic with an opening 232 defined therein. The gift bag 204 may be hung by the opening 232 when the gift bag 204 is folded to form a chip. In some embodiments, the gift bag 204 may also be hung by the handle 226.

In FIG. 2B, the gift bag 204 is illustrated in a partially-unfolded configuration wherein the base panel 216 is folded flat against the front panel 212. From the partially unfolded configuration, the gift bag 204 may be folded in half in the direction of arrow A0 to form the chip illustrated in FIG. 2A. The gift bag 204 may be folded into a rectangular chip generally the size and shape of the rectangular base panel 216. The fastening holes 208 may then be aligned to receive the barbed fasteners 220 or other fasteners therein. In other embodiments, a gift bag may be folded into thirds, or into other rectangular or non-rectangular shapes to form a chip in accordance with the present disclosure.

Figure 3:
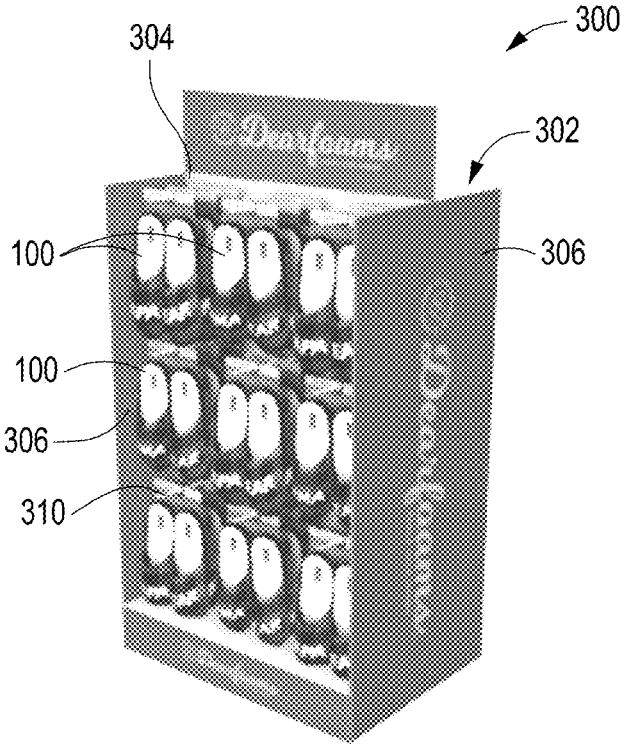
FIG. 3 is a perspective view of an example retail display including a plurality of product assemblies arranged in a hanging orientation.

Referring to FIG. 3, an example retail product display 300 includes a plurality of product assemblies 100 arranged in a hanging orientation. The product display 300 may be constructed of a sturdy material such as cardboard, wood or aluminum, and includes an upright support 302 for supporting the product display 300 on a ground surface. The upright support 302 includes a generally vertical back wall 304 and sidewalls 306 disposed on lateral sides of the back wall 304. A plurality of product support structures, such as hanging rods 310, extend generally horizontally from the back wall 304. The hanging rods 310 may be constructed of a thin metal or plastic, and may support one or more product assemblies 100 thereon in a hanging orientation. For example, each of the hanging rods 310 may extend through the openings 232 of adhesive tabs 230 (FIGS. 2A, 2B) of the product assemblies 100 to support the product assemblies 100 in a hanging orientation. In some embodiments, hanging rods 310 may extend from both sides of the back wall such that the product display 300 may display product assemblies 100 on two opposite sides thereof.

Figure 4:
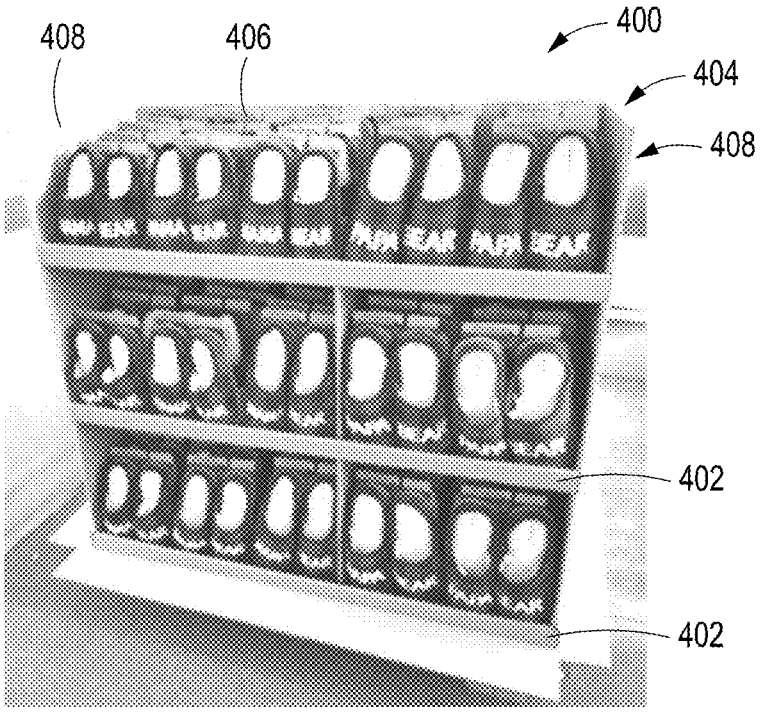
FIG. 4 is a perspective view of an alternate embodiment of a display wherein a plurality of product assemblies are arranged in trays.
Figure 5A:
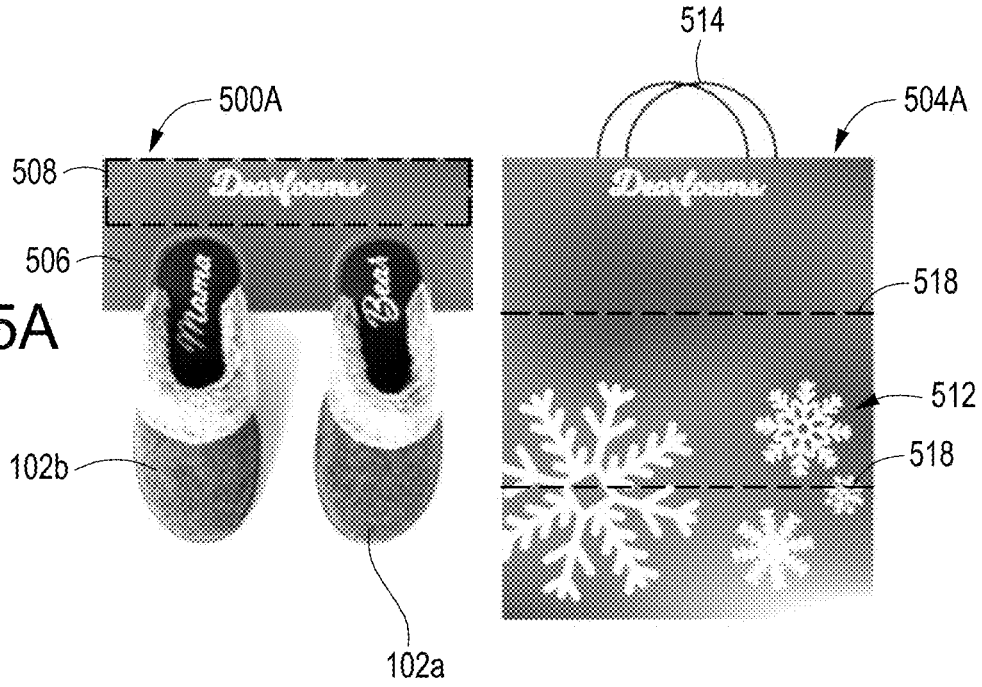
FIGS. 5A through 5D are front views of alternate embodiments of product assemblies with seasonal graphics printed thereon.
Figure 5B:
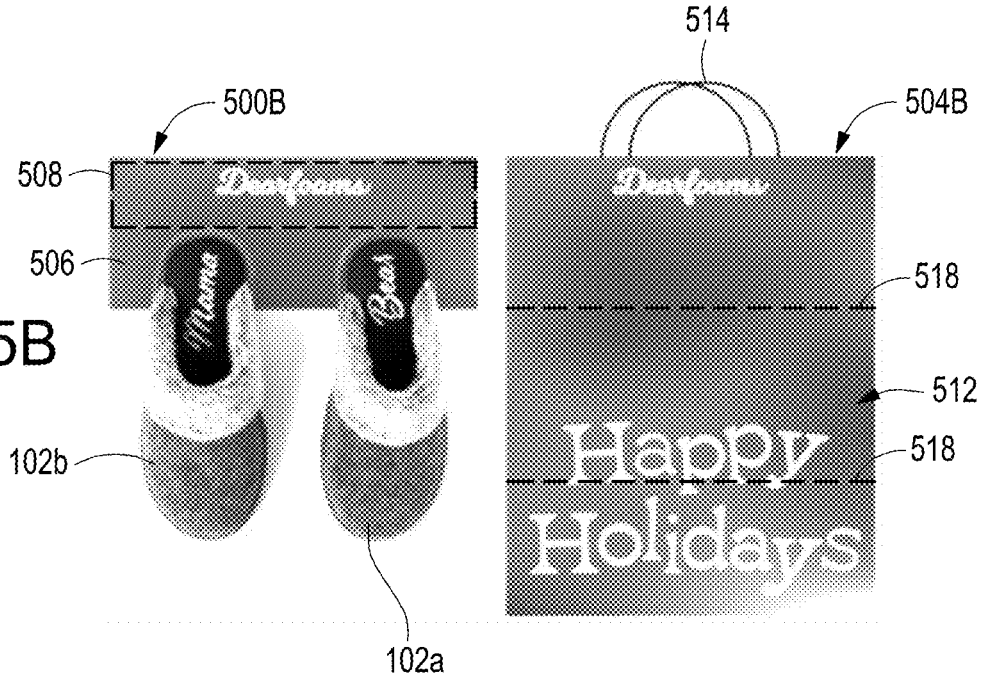
Figure 5C:
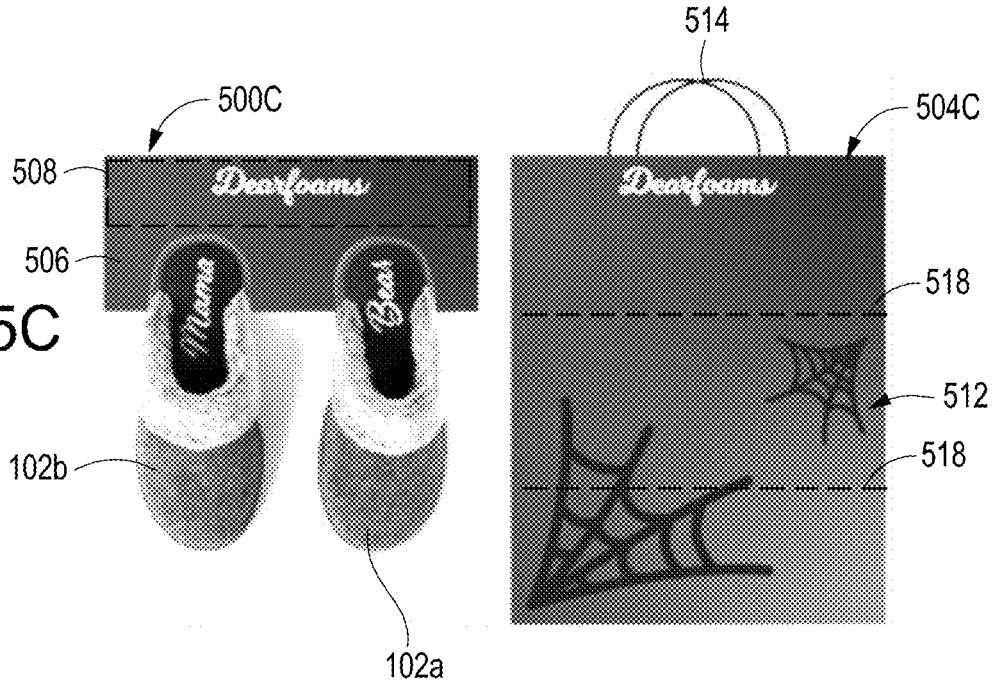
Figure 5D:
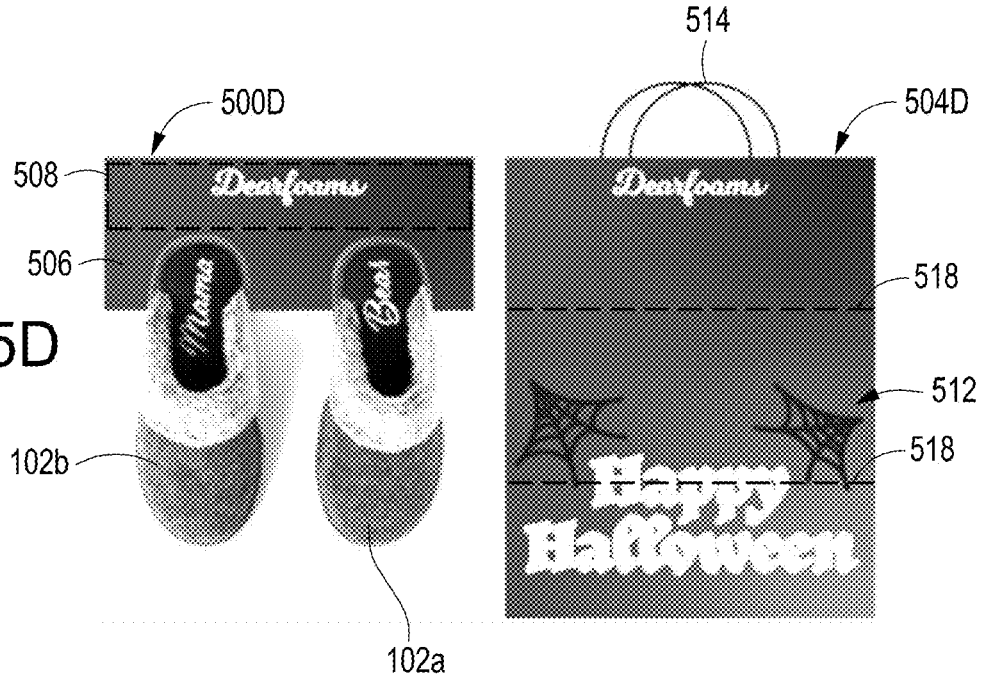

Referring to FIG. 4, an alternate example of a retail product display 400 includes a plurality of product assemblies 100 arranged on product support structures including trays 402. The trays 402 are supported by an upright support 404 including a generally vertical back wall 406 and sidewalls 408 disposed on lateral sides of the back wall 406. The trays 402 may support the product assemblies 100 from beneath such that the gift bags 104 of the product assemblies 100 do not necessarily need to include a mechanism for hanging the product assemblies 100.

Referring to FIGS. 5A through 5D, alternate embodiments of product assemblies 500A, 500B, 500C and 500D are illustrated with seasonal graphics printed on gift bags 504A, 504B, 504C and 504D thereof. A trade name, sizing information or other product identification information is printed of a forward exterior surface 506 of the gift bags 504A, 504B, 504C, 504D in an upper region 508 of the forward exterior surface 506. The product identification information in the upper region 508 may be visible whether the gift bag 504A, 504B, 504C and 504D is folded or unfolded. Even when retail articles 102*a*, 102*b* are affixed to the forward exterior surface, the product identification information in the upper region 508 is visible. A lower region 512 of the gift bag 504A. 504B, 504C, 504D is printed with graphics and text appropriate for holidays, birthdays or other special occasions.

Each of the gift bags 504A, 504B, 504C, 504D includes a handle 514 extending from and interior thereof. The illustrated handles 514 are constructed of thin strands of twisted paper secured to interior surfaces of the gift bags 504A, 504B, 504C, 504D. The handles 514 may be secured within the interior of the gift bags 504A, 504B, 504C, 504D, and the gift bags 504A, 504B, 504C, 504D may be folded along fold lines 518. The gift bags gift bags 504A. 504B, 504C, 504D may thereby be folded into rectangular chips with sufficient rigidity to maintain their shape as the product assemblies 500A, 500B, 500C and 500D are handled by a consumer in a retail environment.

Figure 6:
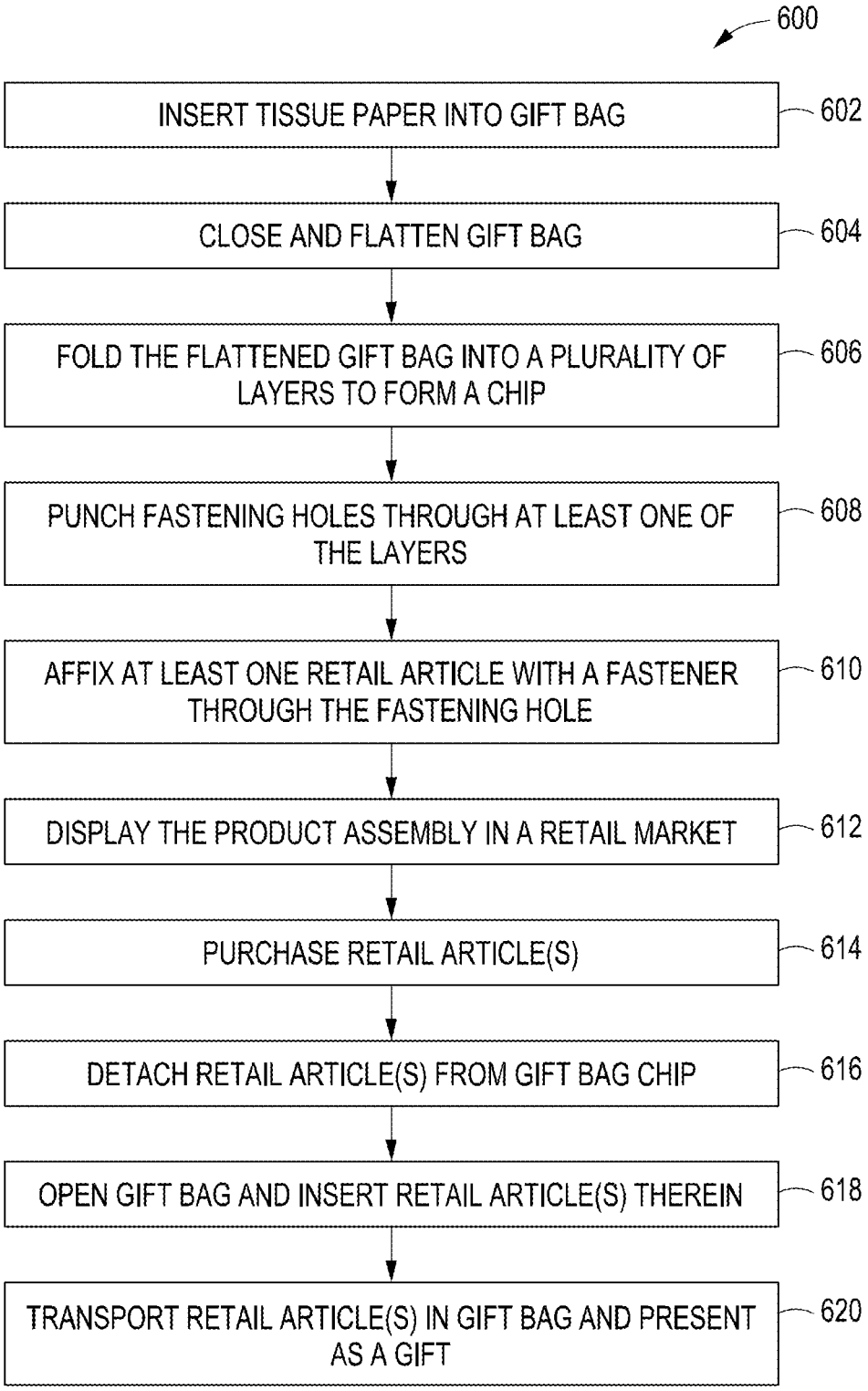
FIG. 6 is a flow chart illustrating a procedure for constructing, displaying and using a product assembly in accordance with the present disclosure

Referring to FIG. 6, and with continued reference to FIGS. 1A through 4, an example procedure 600 for displaying and using a product assembly 100 is illustrated. Initially at step 602 tissue paper 122 may be inserted into an interior of a gift bag 204. The gift bag 204 may be closed and flattened (step 604) with the tissue paper 122 therein. The gift bag 204 may then be folded into a generally flat chip (step 606) including a plurality of adjacent layers. The adjacent layers may include a generally flat base panel 226 arranged behind a forward exterior surface 206. The gift bag 204 may be folded such that the forward exterior surface 206 is generally equal in size and shape to the flat rectangular base panel 206.

At step 608, one or more fastening holes 208 may be punched through the one or more adjacent layers of the chip formed from the gift bag 204. In some embodiments, the fastening holes 208 may be punched through each of the adjacent layers while the gift bag 204 is folded into the chip such that the fastening holes 208 passing through the various layers are aligned with one another. One or more retail articles 102*a*, 102*b* may then be attached to the forward exterior surface 206 (step 610) by passing a fastener 220 through the fastening holes. In some embodiments, the fastener 220 may retain the various layers adjacent one another in a folded configuration. Once the retail articles 102*a*, 102*b* are attached, the product assembly 100 is assembled.

The procedure 600 may then proceed to step 612 where the product assembly 100 may be displayed, for example on a product display 300, 400. The product assembly 100 may be suspended from a hanging rod 310 or arranged on trays 402. The product assembly 100 may then be purchased by a consumer (step 614)

At step 616, the consumer may detach the retail articles 102*a*, 102*b* from the display chip formed from the gift bag 204. For example, the consumer may cut the fastener 220 to release the retail articles retail articles 102*a*, 102*b* from the gift bag 204 and to allow the gift bag 204 to be unfolded. The gift bag 204 may then be opened, and the retail articles 102*a*, 102*b* may be inserted into an interior thereof (step 618). The retail articles 102*a*, 102*b* may then be transported within the gift bag 204 and presented as a gift (step 620).

Figure 7:
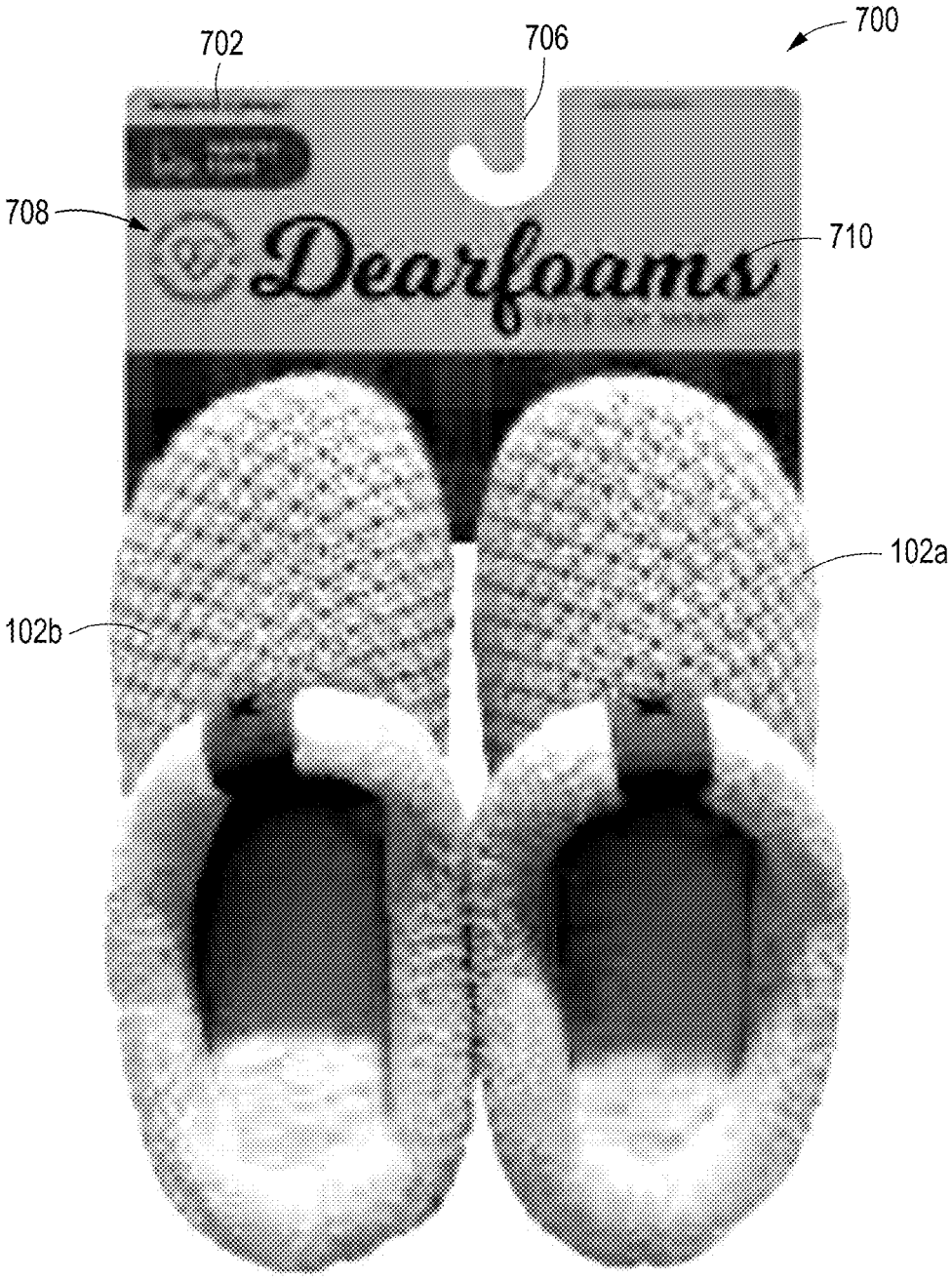
FIG.7 (Prior Art)
FIG. 7 is a front view of a conventional display chip with retail articles attached.

Referring to FIG. 7, a product assembly 700 with a conventional display chip 702 is illustrated. The display chip 702 is constructed of a generally rectangular, flat cardboard sheet. The cardboard sheet may constructed of a corrugated cardboard and may have a thickness of 3 mm (about ⅛ inch) or grater such that the display chip is sufficiently sturdy to support the retail articles 102*a*, 102*b* when the product assembly 700 is handled by a consumer. A curved, j-shaped slot 706 is formed within the display chip 702 to permit the product assembly 700 to be hung in a retail display (see FIG. 3). The retail items 102*a*, 102*b* are secured to a forward exterior surface 708 the display chip 602 by a fastener or other mechanisms. Product identification markings 710 are provided on the forward exterior surface 708 above the retail items 102*a*, 102*b*. Once the retail items 102*a*, 102*b* are removed, the display chip 702 may be discarded.

Figures 8, 9:
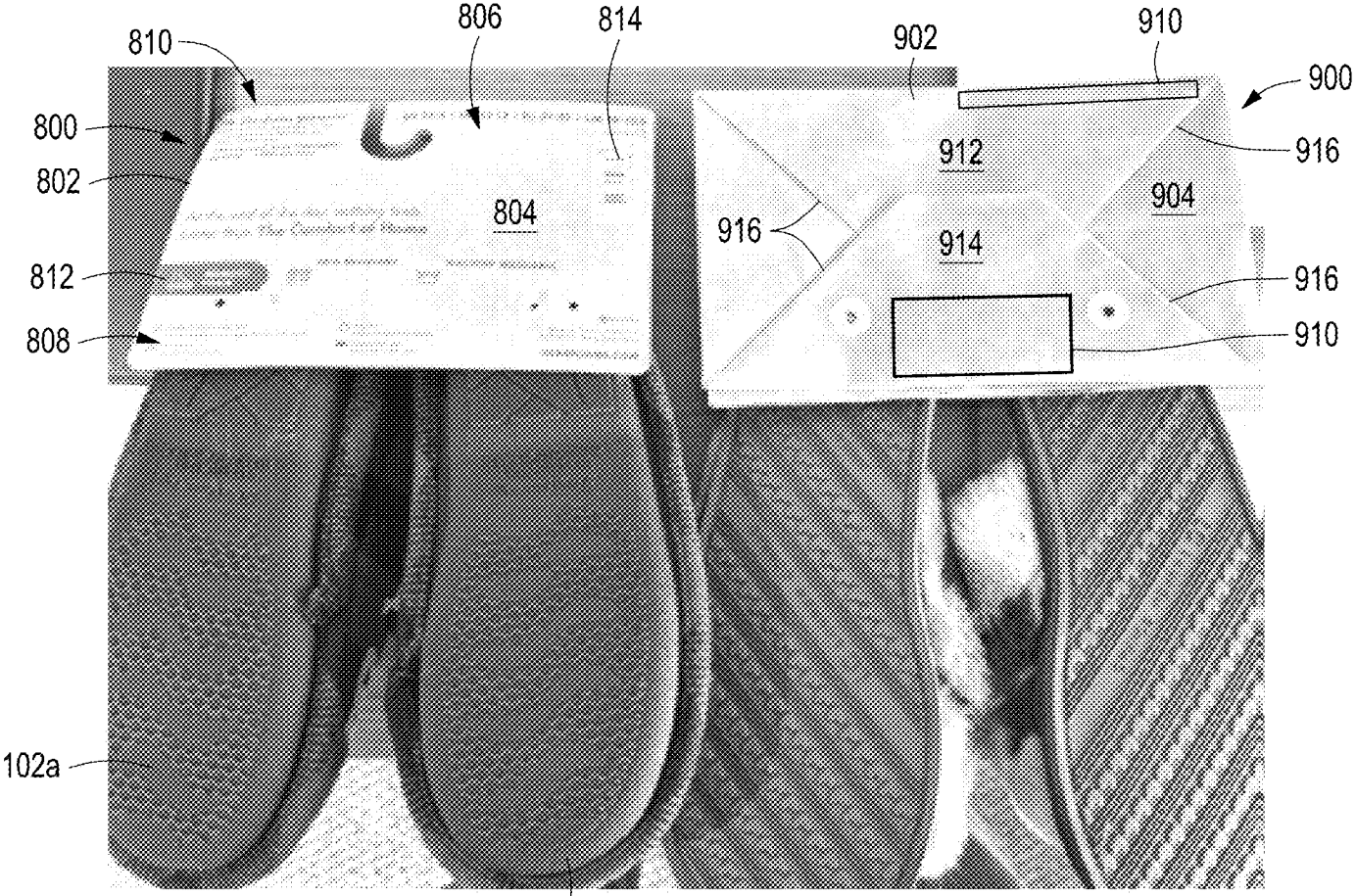
FIG.8 (Prior Art)
FIG. 8 is a rear view of a conventional display chip illustrating sizing and other product identification markings on a back surface of the display chip.
FIG. 9 is a rear view of a product assembly in accordance with the present disclosure with product identification markings on a bottom surface of a gift bag.

Referring to FIG. 8, a product assembly 800 with a conventional display chip 802 is illustrated. Markings on a rear face 804 of the chip 802 include size information 806, care instructions 808, manufacturer or brand information 810 and marketing information 812 related to retail articles 102*a*, 102*b* coupled to the chip 802. A Universal Product Code (UPC) barcode 814 is also affixed to the rear face 804 of the chip 802. These auxiliary markings 806, 808, 810, 812 and 814 may supplement product identification markings 710 (FIG. 7) on a forward exterior surface.

As illustrated in FIG. 9, a product assembly 900 in accordance the present disclosure is illustrated. A gift bag 902 is folded into a chip, and a rear face 904 of the chip is formed from a bottom surface (a base panel) of the gift bag 902. In some embodiments, auxiliary markings 910 may be printed on the rear face 904 in areas that are fully enclosed in a single panel 912, 914 defined between fold lines 916. The auxiliary markings 910 are legible when the gift bag 902 is folded into a chip. When the gift bag 902 is unfolded and presented as a gift, the auxiliary markings 910 may not be visible since the auxiliary markings are printed on the bottom surface of the gift bag 902.

Figure 10:
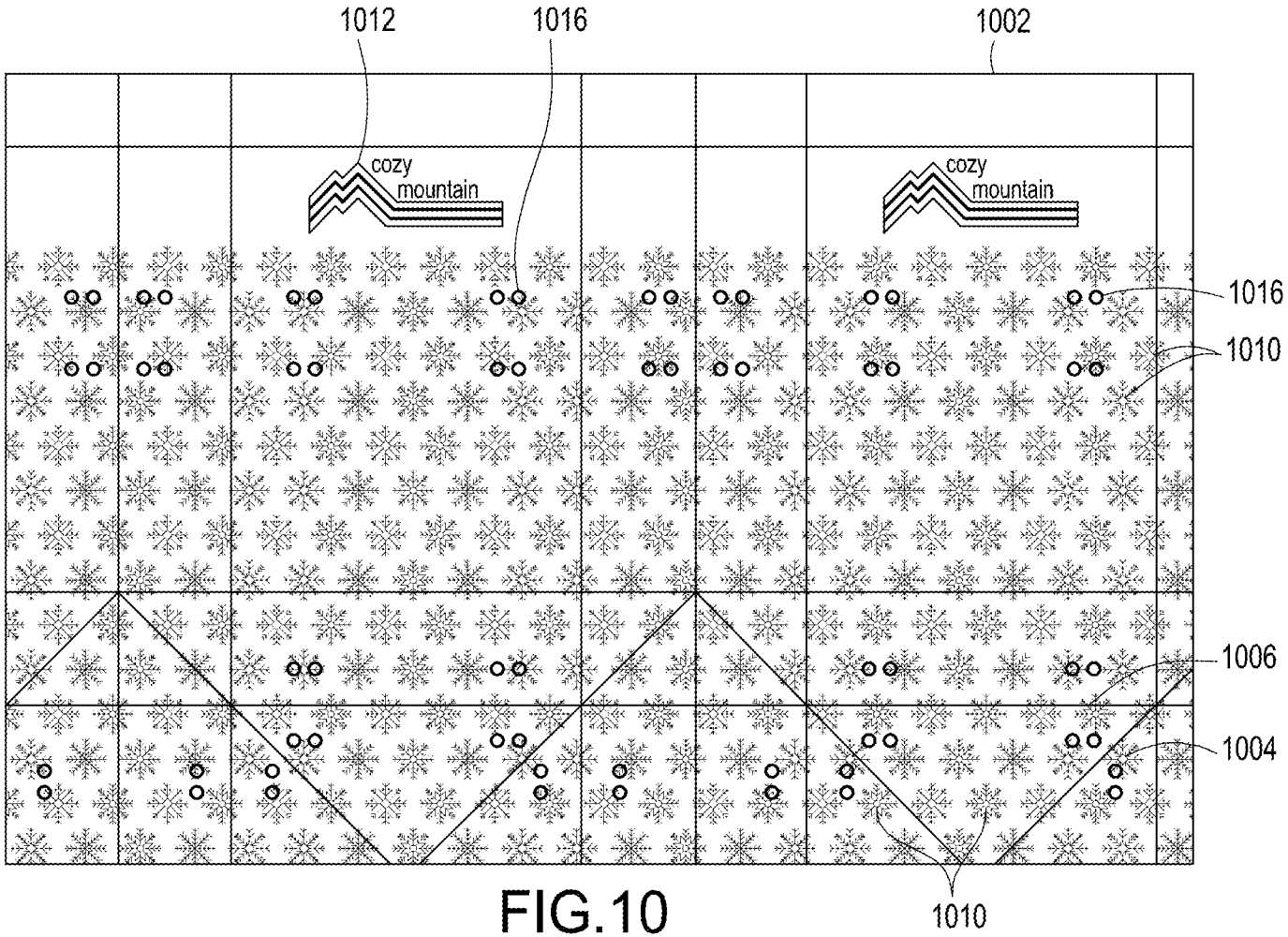
FIG. 10 is a top view of printed sheet, which may be folded into a gift bag in accordance embodiments of the present disclosure.

In other embodiments, no auxiliary markings may be present on a bottom of a gift bag in accordance with the present disclosure. Referring to FIG. 10, a printed sheet 1002 is illustrated, which may be folded into a gift bag. The printed sheet 1002 includes a lower region 1004 below a fold line 1006 that forms a bottom of the gift bag. The lower region 1004 includes designs 1010 printed thereon, but no auxiliary markings. Product identification markings 1012 are printed on an upper region 1014 of the printed sheet 1002 above the fold line 1006 which may form front and rear panels of a gift bag. The product identification markings 1012 may be visible on a forward exterior surface when the printed sheet is folded into a gift bag and the gift bag is folded into a chip.

The fold line 1006 and other fold lines visible in FIG. 10 may or may not be printed on the printed sheet 1002. Similarly, circles 1016 visible in FIG. 10 may or may not be printed on the printed sheet 1002. The circles 1016 represent areas which may be punched out to form fastening holes to affix retail articles to a chip. As illustrated in FIG. 10, 64 circles are illustrated, which may align with one another when the printed sheet 1002 is folded into a chip, such that 8 fastening holes are formed through the entire chip.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A product assembly, comprising:

a gift bag folded into a generally flat chip including a plurality of adjacent layers and defining a forward exterior surface thereon; and at least one retail article secured to the forward exterior surface;

wherein the gift bag, when unfolded and opened, is arranged to receive the at least one retail article into an interior thereof once the at least one retail item is detached from the forward exterior surface;

wherein the gift bag includes a flat rectangular base panel, wherein the gift bag is folded such that the base panel forms an exterior rear face of the chip; and wherein auxiliary markings related to the at least one retail article are printed on the base panel, and wherein the auxiliary markings include at least one of the group consisting of size information, care instructions, manufacturer information, brand information, marketing information, and a Universal Product Code barcode.

2. The product assembly of claim 1, wherein the at least one retail article includes a footwear set.

3. The product assembly of claim 2, wherein the footwear set includes two footwear members arranged in a side-by-side relationship on the forward exterior surface, and wherein the footwear members extend beyond an edge of the forward exterior surface while leaving an upper region of the forward exterior surface unobscured for product identification markings.

4. The product assembly of claim 1, wherein the gift bag includes product identification markings on the forward exterior surface thereof such that the product identification markings are visible when the gift bag is folded into a generally flat chip with the footwear set attached and visible when the gift bag is unfolded and opened.

5. The product assembly of claim 1, wherein the gift bag includes at least one fastening hole extending through at least one layer of the plurality of adjacent layers.

6. The product assembly of claim 5, further comprising a fastener extending through the at least one retail article retail article and the at least one fastening hole to secure the at least one retail article to the forward exterior surface.

7. The product assembly of claim 6, wherein the fastener extends through each layer of the plurality of adjacent layers to retain the layers adjacent one another in a folded configuration.

8. The product assembly of claim 1, wherein the gift bag is folded such that the forward exterior surface is generally equal in size and shape to the flat rectangular base panel.

9. The product assembly of claim 8, wherein the gift bag includes fold lines configured to facilitate folding the gift bag from an unfolded configuration into the generally flat chip, and wherein the fold lines are positioned such that when the gift bag is folded into the chip, the forward exterior surface and the base panel are substantially parallel and separated by the plurality of adjacent layers.

10. The product assembly of claim 1, further comprising tissue paper contained within the interior of the gift bag when the gift bag is folded into a generally flat chip.

11. The product assembly of claim 1, further comprising a handle extending from an interior of the gift bag.

12. The product assembly of claim 1, further comprising a tab extending from the gift bag, wherein the tab includes an opening therein from which the product assembly may be suspended.

* * * * *